US008640900B2

(12) United States Patent
Heisner et al.

(10) Patent No.: US 8,640,900 B2
(45) Date of Patent: Feb. 4, 2014

(54) PLASTIC CONTAINER HAVING REINFORCED GRIPPING STRUCTURE

(75) Inventors: David B. Heisner, York, PA (US); Stephen R. Guerin, Milford, NH (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 13/244,999

(22) Filed: Sep. 26, 2011

(65) Prior Publication Data

US 2012/0228258 A1 Sep. 13, 2012

Related U.S. Application Data

(60) Provisional application No. 61/451,896, filed on Mar. 11, 2011.

(51) Int. Cl.
*B65D 90/02* (2006.01)
*B65D 23/10* (2006.01)
*B65D 1/02* (2006.01)

(52) U.S. Cl.
CPC ..... *B65D 23/102* (2013.01); *B65D 1/0223* (2013.01)
USPC ..... 215/384; 220/675

(58) Field of Classification Search
USPC ..... 215/384, 383, 382, 379, 40; 220/675, 220/672, 670, 669; D7/584; D9/530, 563, D9/569, 559
IPC ..... B65D 90/02
See application file for complete search history.

(56) References Cited

U.S. PATENT DOCUMENTS

| | | | | | |
|---|---|---|---|---|---|
| 5,056,674 | A * | 10/1991 | Swartley | 215/382 |
| 5,092,474 | A * | 3/1992 | Leigner | 215/381 |
| 5,141,120 | A * | 8/1992 | Brown et al. | 215/381 |
| 5,178,289 | A * | 1/1993 | Krishnakumar et al. | 215/382 |
| 5,392,937 | A * | 2/1995 | Prevot et al. | 215/400 |
| 5,803,290 | A * | 9/1998 | Bongiorno | 215/384 |
| 5,971,184 | A * | 10/1999 | Krishnakumar et al. | 215/384 |
| 6,095,360 | A * | 8/2000 | Shmagin et al. | 215/382 |
| 6,318,583 | B1 * | 11/2001 | Owens | 220/672 |
| 7,172,087 | B1 * | 2/2007 | Axe et al. | 215/382 |
| D606,879 | S * | 12/2009 | Nelson et al. | D9/667 |
| 2002/0008077 | A1 * | 1/2002 | Lane et al. | 215/381 |
| 2004/0016716 | A1 * | 1/2004 | Melrose et al. | 215/381 |
| 2004/0149677 | A1 * | 8/2004 | Slat et al. | 215/380 |
| 2007/0090083 | A1 * | 4/2007 | Trude | 215/384 |
| 2008/0237180 | A1 * | 10/2008 | Inomata | 215/376 |

* cited by examiner

*Primary Examiner* — Robert J Hicks
(74) *Attorney, Agent, or Firm* — Baker Botts LLP

(57) ABSTRACT

A plastic container includes a shoulder portion having an annular rib defined therein and a generally cylindrical main body portion having a longitudinal axis. At least one gripping recess is defined in the main body portion that has an oblong shape when viewed in front elevation and that is defined in part by a curved concave inner surface when viewed in side elevation. The gripping recess includes a plurality of horizontal indentations, each of which is sized to receive a finger of a consumer when the plastic container is being gripped by the consumer.

25 Claims, 10 Drawing Sheets

PLASTIC CONTAINER HAVING REINFORCED GRIPPING STRUCTURE

This is a continuation-in-part of Ser. No. 12/207,696, filed Sep. 10, 2008, the entire disclosure of which is hereby incorporated by reference. This application also claims priority under 35 U.S.C. §119(e) to Provisional Application Ser. No. 61/451,896, filed Mar. 11, 2011, the entire disclosure of which is also hereby incorporated by reference.

BACKGROUND OF THE INVENTION

1. Field of the Invention

This invention relates generally to the field of plastic containers, and more particularly to plastic containers that are intended for consumer use and that are fabricated using a blow molding process.

2. Description of the Related Technology

Molded plastic containers for packaging beverages such as orange juice are in wide commercial use throughout the world. Such containers may be fabricated using the extrusion blow molding process, which is typical for containers that are fabricated from a material such as polyolefin, or a stretch blow molding process, which is typical for containers that are fabricated from polyethylene terephthalate, which is commonly known as PET.

When filled with a product, molded plastic containers can be fairly heavy and difficult to handle by some consumers, particularly in the larger sizes. This problem is compounded by any condensation in the form on the exterior surface of the plastic container. Accordingly, it is typical for certain types of plastic containers to be designed with integrated gripping recesses and handles so as to facilitate safety and ease of handling by the consumer.

The configuration of many containers incorporating such gripping recesses and handles is such that a consumer will be induced to grip the container using the forefingers and the thumb in a pinching action that can impart significant compressive forces to the container. While this may facilitate a comfortable and effective manner in which to grip the container from the standpoint of the consumer, the resulting compressive forces, which tend to be concentrated near the recessed grip portions of the container, can result in significant inward deflection and deformation of the container. Such deformation can result in a reduction of the storage volume of the container, causing product to be forced out of the pouring opening of the container in unwanted fashion when the container is full or close to being full. In addition, such deformation can result in a change in the pouring characteristics of the container, either by changing the shape of the dispensing opening itself or the shape of the surfaces that are immediately adjacent to the dispensing opening.

In addition, some plastic containers must be designed to withstand significant pressure differentials between the inside of the container and ambient conditions. Carbonated beverages or malt beverages can generate significant internal pressure, on the order of 45-60 psi for malt beverages such as beer. Beer can be packaged using a cold aseptic or cold filtered process, or it can be pasteurized after filling and capping the container in order to kill any remaining yeast and stop further fermentation of the product. The pasteurization process typically involves spraying the filled and capped containers with hot water until the internal temperatures reach 140-142 degrees Fahrenheit.

Plastic containers may also be designed for use in the hot fill process, which is typically used for packaging beverages such as fruit juices. For such containers, gripping recesses must be designed to withstand pressurization and the subsequent volumetric contraction that occurs during the hot-fill process.

A need exists for an improved plastic container that provides a safe and convenient gripping configuration for the consumer but that exhibits better resistance against deformation than has been the case with conventional designs.

SUMMARY OF THE INVENTION

Accordingly, it is an object of the invention to provide an improved plastic container that provides a safe and convenient gripping configuration for the consumer but that exhibits better resistance against deformation than has been the case with conventional designs.

In order to achieve the above and other objects of the invention, a plastic container according to a first aspect of the invention includes a main body portion having a longitudinal axis, the main body portion having a gripping recess defined therein, the gripping recess being defined in part by a curved concave inner surface when viewed in side elevation, the gripping recess further comprising a plurality of horizontal indentations, each of the horizontal indentations being sized to receive a finger of a consumer when the plastic container is being gripped by the consumer.

A plastic container according to a second aspect of the invention includes a main body portion having a longitudinal axis, the main body portion having a gripping recess defined therein, the gripping recess having an oblong shape when viewed in front elevation, the gripping recess further comprising a plurality of horizontal indentations, each of the horizontal indentations being sized to receive a finger of a consumer when the plastic container is being gripped by the consumer.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
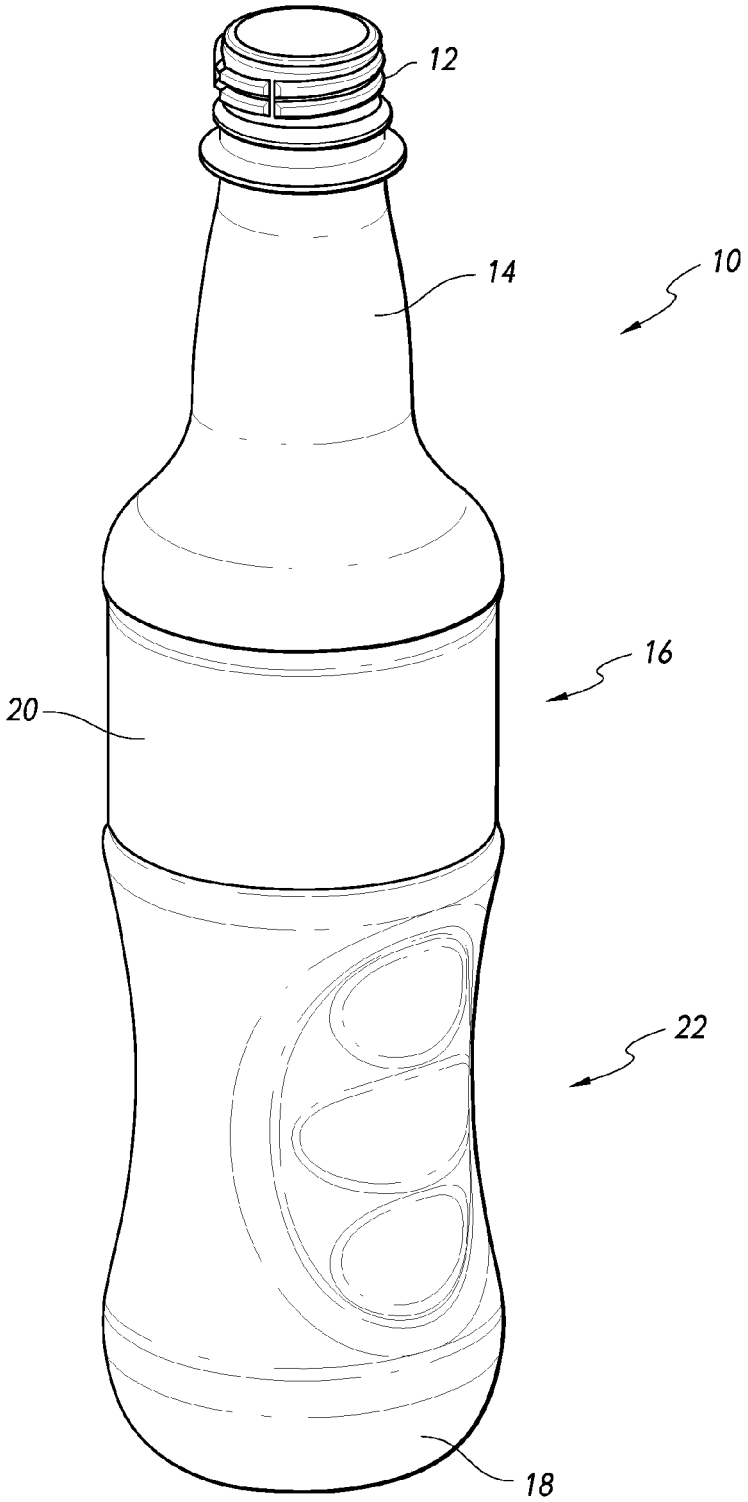
FIG. 1 is a perspective view depicting a container that is constructed according to a preferred embodiment of the invention.

Referring now to the drawings, wherein like reference numerals designate corresponding structure throughout the views, and referring in particular to FIG. 1, a plastic container 10 that is constructed according to a preferred embodiment of the invention includes a conventional threaded finish portion 12, a neck portion 14, a main body portion 16 and a conventional bottom portion 18.

Containers 10 may be fabricated using the extrusion blow molding process, which is typical for containers that are fabricated from a material such as polyolefin, or a stretch blow molding process, which is typical for containers that are fabricated from polyethylene terephthalate, which is commonly known as PET.

Plastic container 10 is shaped so as to be generally cylindrical and further includes a substantially smooth label panel 20 to which a label may be conveniently applied using conventional processes.

Plastic container 10 further includes an opposed pair of gripping recesses 22 that are constructed to facilitate gripping of the container 10 by a consumer when the container 10 is full of liquid. Each of the gripping recesses 22 is constructed so as to be able to withstand pressurization and volumetric contraction that may occur within the container 10 as a result of carbonation, pasteurization, the hot-fill process or that may occur during transportation or use of the container 10.

Figure 2:
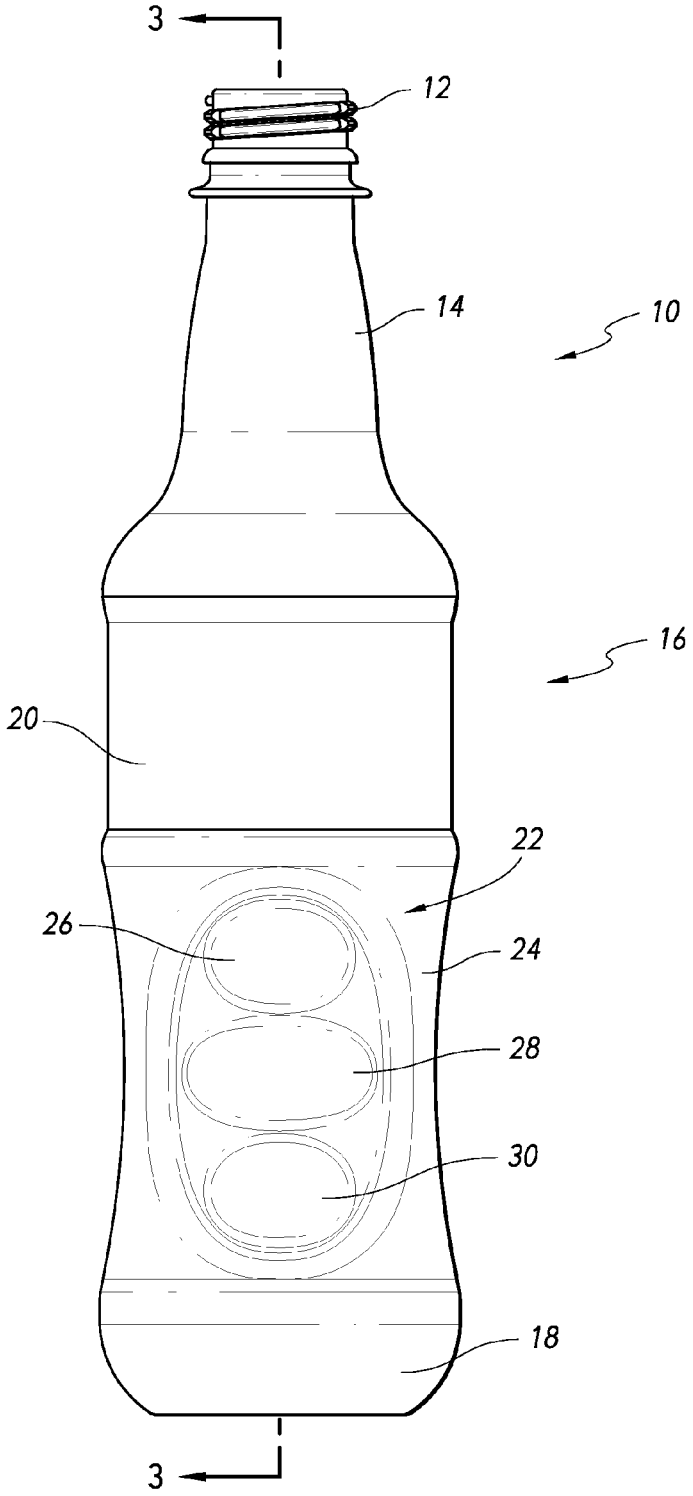
FIG. 2 is a front elevational view depicting the container that is shown in FIG. 1.

Referring briefly to FIG. 2, it will be seen that each of the gripping recesses 22 has an outer boundary 24 when viewed in front elevation that has an oblong shape, with a major axis that is substantially vertical or parallel to the longitudinal axis of the plastic container 10. The oblong shape of the gripping recesses 22 is preferably substantially symmetrical about both the major vertical axis and the minor horizontal axis. As may best be seen in FIG. 4, each of the gripping recesses 22 is also defined in part by a curved concave inner surface 32 when viewed in side elevation.

Each of the gripping recesses 22 includes a plurality of horizontal indentations, each of which are sized to receive a finger of the consumer when the plastic container is being gripped by the consumer. In the preferred embodiment, three horizontal recesses or indentations 26, 28 and 30 are provided. As viewed in longitudinal cross-section, a first lip or projection 36 is defined between the recesses 26, 28 and a second lip or projection 38 is defined between the recesses 28, 30.

Referring again to FIG. 4, plastic container 10 has a maximum outer diameter $D_{MAX}$. Preferably, the curved concave inner surfaces 32 of the gripping recesses 22 each have a radius $R_{IS}$ that is within a range of about 30 percent to about 130 percent of the maximum outer diameter $D_{MAX}$ of the container 10, and that is more preferably within a range of about 50 percent to about 100 percent of the maximum outer diameter $D_{MAX}$ of the container 10.

Figure 5:
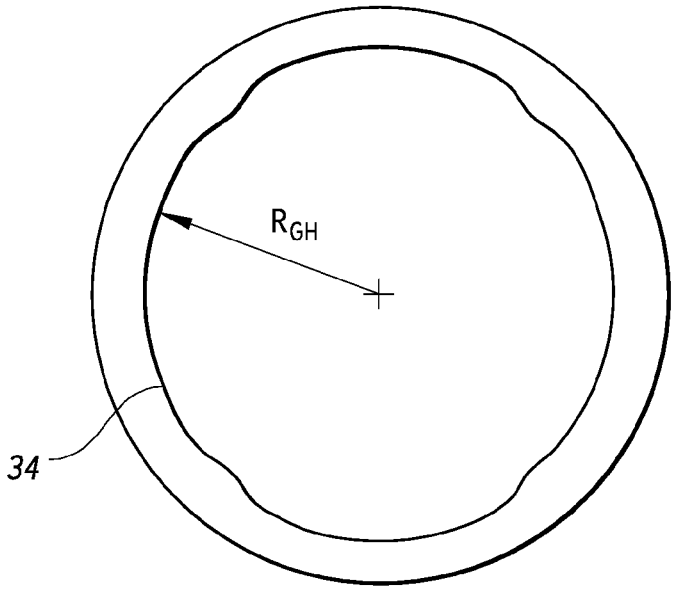
FIG. 5 is a cross-sectional view taken along lines 5-5 in FIG. 4.

In the preferred embodiment, each of the horizontal indentations 26, 28, 30 has an outer surface 34 that is convexly curved as viewed in horizontal cross section, as is best shown in FIG. 5. Outer surface 34 in the preferred embodiment has a radius of curvature $R_{GH}$ that is within a range of about 20 percent to about 70 percent of the maximum outer diameter $D_{MAX}$ of the container 10, and that is more preferably within a range of about 30 percent to about 60 percent of the maximum outer diameter $D_{MAX}$ of the container 10.

Figure 3:
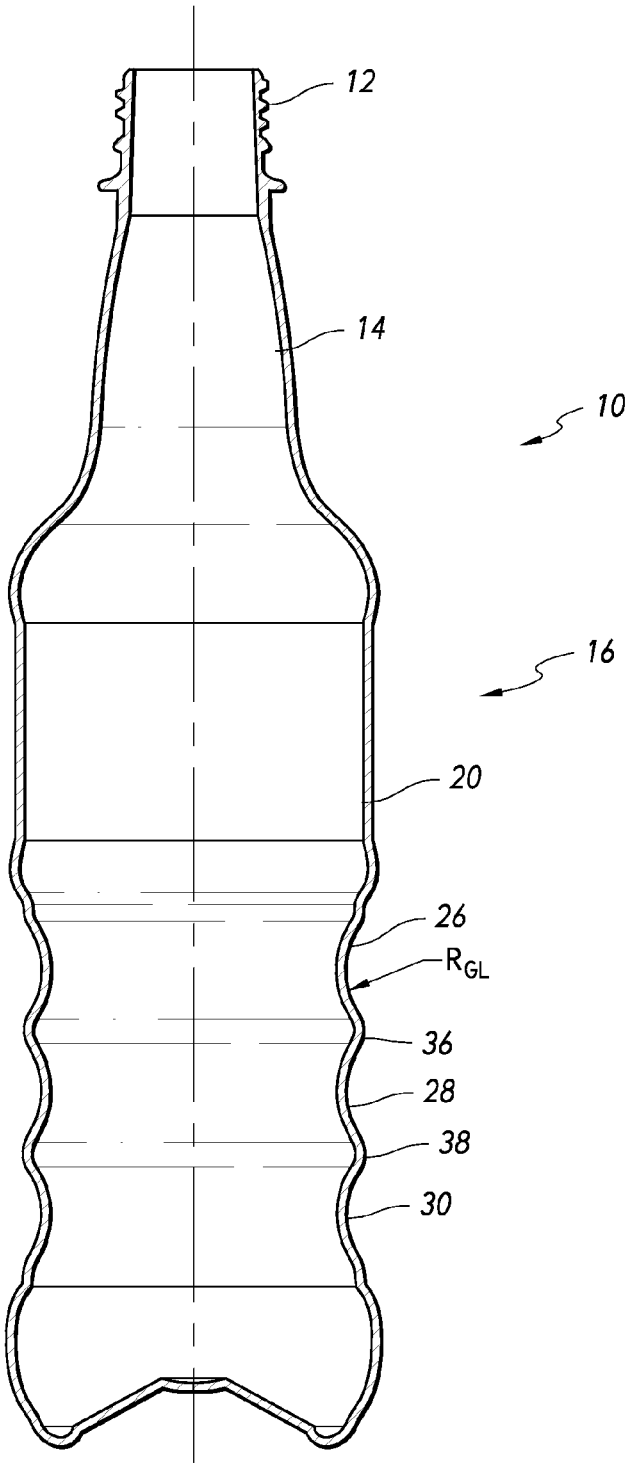
FIG. 3 is a longitudinal cross-sectional view taken along lines 3-3 in FIG. 2.
Figure 4:
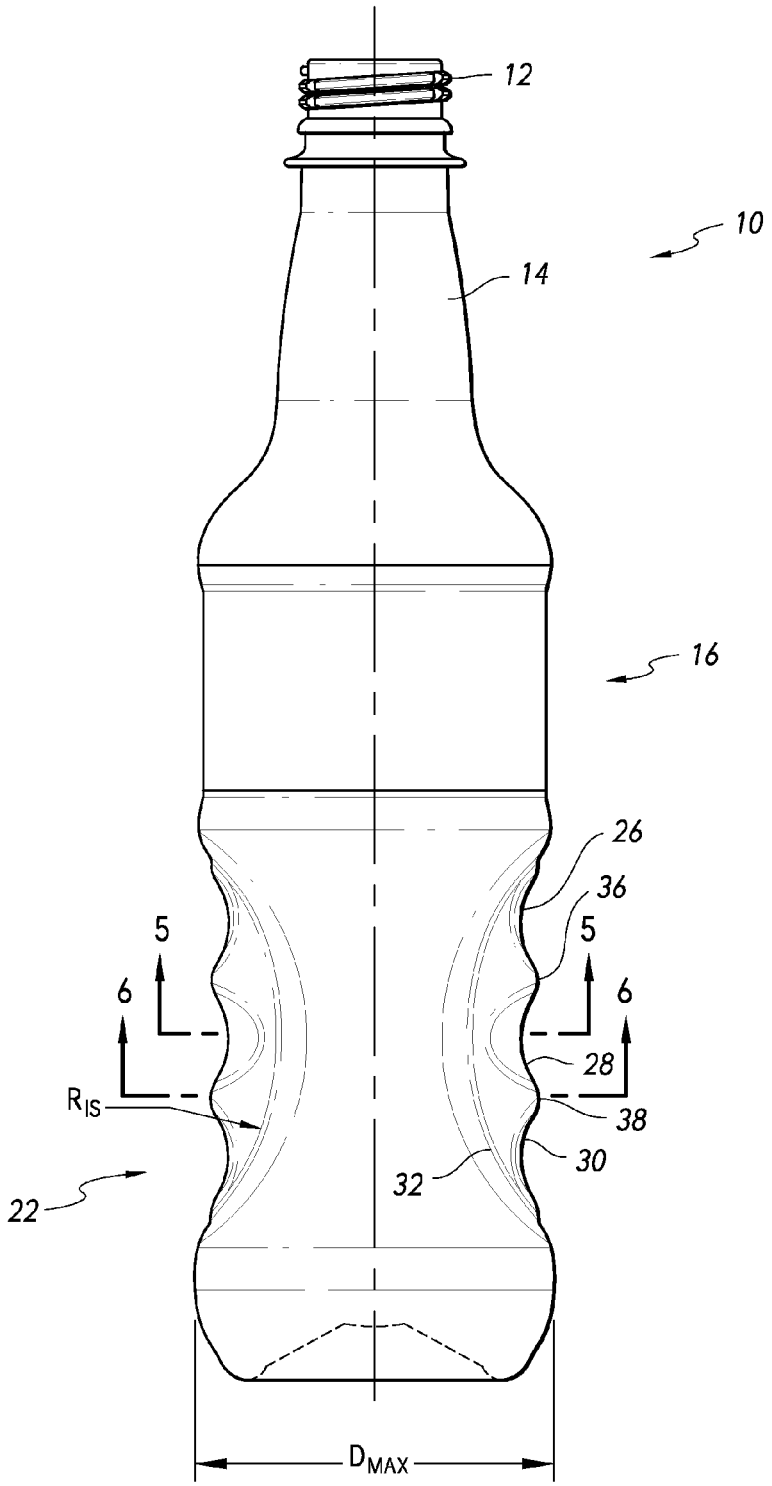
FIG. 4 is a side elevational view depicting the container that is shown in FIG. 1.

The outer surface 34 of each of the horizontal indentations 26, 28, 30 is also preferably concave as viewed in longitudinal cross-section, as is best shown in FIGS. 3 and 4. Each of the horizontal indentations 26, 28, 30 preferably has a longitudinal radius of curvature $R_{GL}$ that is preferably within a range of about 0.2 inches to about 1 inch, and that is more preferably within a range of about 0.45 inch to about 0.85 inch. Preferably, the longitudinal radius of curvature $R_{GL}$ is within a range of about 15% to about 35% of the maximum outer diameter $D_{MAX}$ of the container 10.

Figure 6:
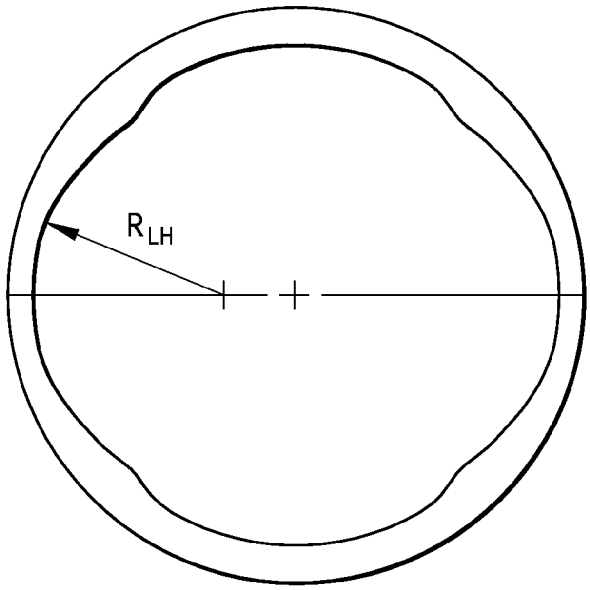
FIG. 6 is a cross-sectional view taken along lines 6-6 in FIG. 4.

FIG. 6 is a horizontal cross-sectional view depicting a cross-section of the container 10 taken at an elevation that intersects the second lip or projection 38. Both of the lips or projections 36, 38 have an outer surface that is convexly curved at a radius of curvature $R_{LH}$ that is preferably within a range of about 20 percent to about 50 percent of the maximum outer diameter $D_{MAX}$ of the container. Preferably, the radius of curvature $R_{LH}$ is within a range of about 0.6 inch to about 1.1 inch.

A plastic container 110 that is constructed according to an alternative embodiment of the invention is depicted in FIGS. 7-11. Plastic container 110 includes a conventional threaded finish portion 112, a neck portion 114, a main body portion 116 and a conventional bottom portion 118.

The neck portion 114 may include a shoulder that defines a subtle annular rib 111, which imparts additional pressure resistance to the container 110. The annular rib 111 is preferably convex, as may clearly be seen in FIGS. 8 and 9, and has an average radius of curvature $R_R$. Preferably, a ratio of the average radius of curvature $R_R$ to the maximum outer diameter of the container is substantially within a range of about 0.10 to about 0.30, and more preferably substantially within a range of about 0.15 to about 0.25.

Container 110 may be fabricated using the extrusion blow molding process, which is typical for containers that are fabricated from a material such as polyolefin, or a stretch blow molding process, which is typical for containers that are fabricated from polyethylene terephthalate, which is commonly known as PET.

Plastic container 110 is shaped so as to be generally cylindrical and further includes a substantially smooth label panel 120 to which a label may be conveniently applied using conventional processes.

Plastic container 110 further includes an opposed pair of gripping recesses 122 that are constructed to facilitate gripping of the container 110 by a consumer when the container 110 is full of liquid. Each of the gripping recesses 122 is constructed so as to be able to withstand pressurization and volumetric contraction that may occur within the container 110 as a result of carbonation, pasteurization, the hot-fill process or that may occur during transportation or use of the container 10.

Figure 8:
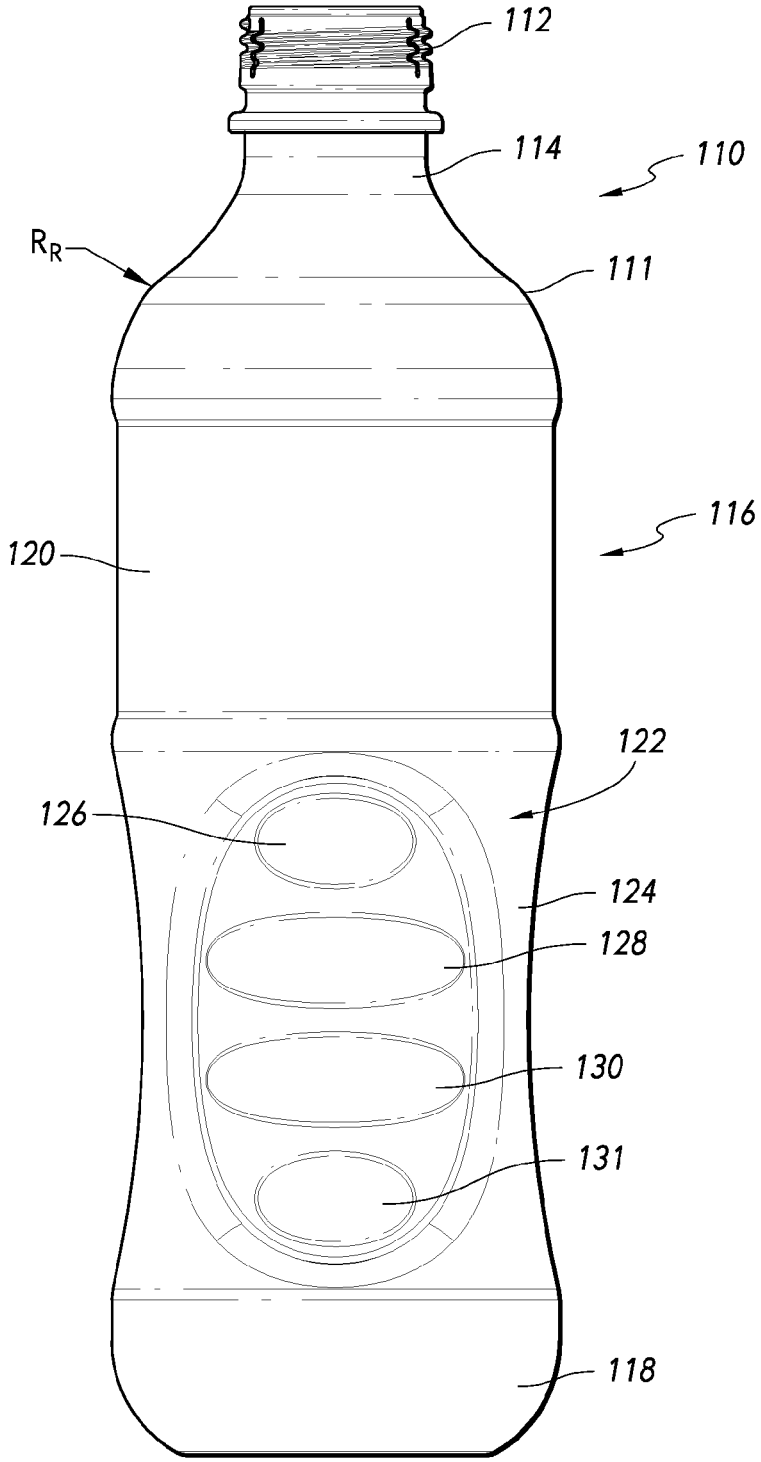
FIG. 8 is a side elevational view of the container that is shown in FIG. 7.

Referring briefly to FIG. 8, it will be seen that each of the gripping recesses 122 has an outer boundary 124 when viewed in front elevation that has an oblong shape, with a major axis that is substantially vertical or parallel to the longitudinal axis of the plastic container 110. The oblong shape of the gripping recesses 122 is preferably substantially symmetrical about both the major vertical axis and the minor horizontal axis. As may best be seen in FIG. 9, each of the gripping recesses 122 is also defined in part by a curved concave inner surface 132 when viewed in side elevation.

Each of the gripping recesses 122 includes a plurality of horizontal indentations, each of which are sized to receive a finger of the consumer when the plastic container is being gripped by the consumer. In this embodiment, four horizontal recesses or indentations 126, 128, 130 and 131 are provided. As viewed in longitudinal cross-section, a first lip or projection 136 is defined between the recesses 126, 128, a second lip or projection 138 is defined between the recesses 128, 130 and a third lip or projection 139 is defined between the recesses 128, 130.

Referring again to FIG. 9, plastic container 110 has a maximum outer diameter $D_{MAX}$. Preferably, the curved concave inner surfaces 132 of the gripping recesses 122 each have a radius $R_{IS}$ that is within a range of about 30 percent to about 130 percent of the maximum outer diameter $D_{MAX}$ of the container 110, and that is more preferably within a range of about 50 percent to about 100 percent of the maximum outer diameter $D_{MAX}$ of the container 110. Most preferably, the radius $R_{IS}$ is substantially within a range of about 70% to about 90% of the maximum outer diameter $D_{MAX}$ of the container 110.

Figure 10:
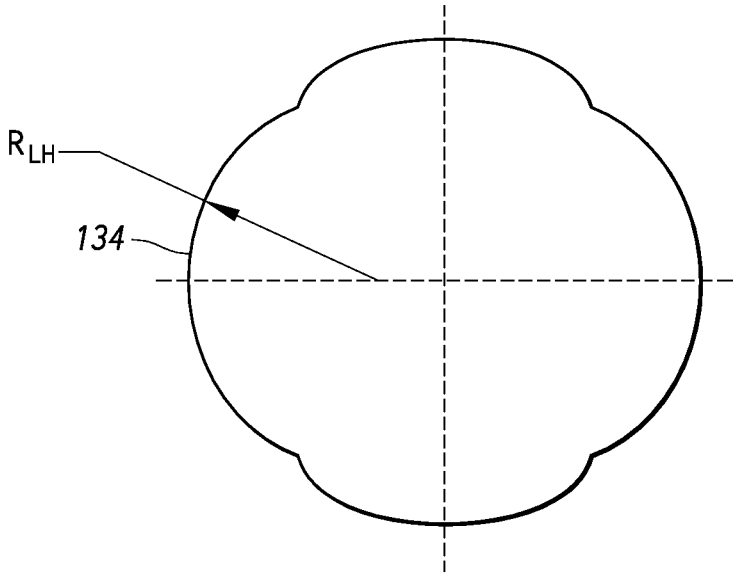
FIG. 10 is a cross-sectional view taken along lines 10-10 in FIG. 9.

In the preferred embodiment, each of the horizontal indentations 126, 128, 130, 131 has an outer surface 134 that is convexly curved as viewed in horizontal cross section, as is best shown in FIG. 10. Outer surface 134 in the preferred embodiment has a radius of curvature $R_{GH}$ that is within a range of about 20 percent to about 70 percent of the maximum outer diameter $D_{MAX}$ of the container 110, and that is more preferably within a range of about 25 percent to about 60 percent of the maximum outer diameter $D_{MAX}$ of the container 10. Most preferably, the outer surface 134 has a radius of curvature $R_{GH}$ that is substantially within a range of about 30 percent to about 40 percent of the maximum outer diameter $D_{MAX}$ of the container 110.

Figure 7:
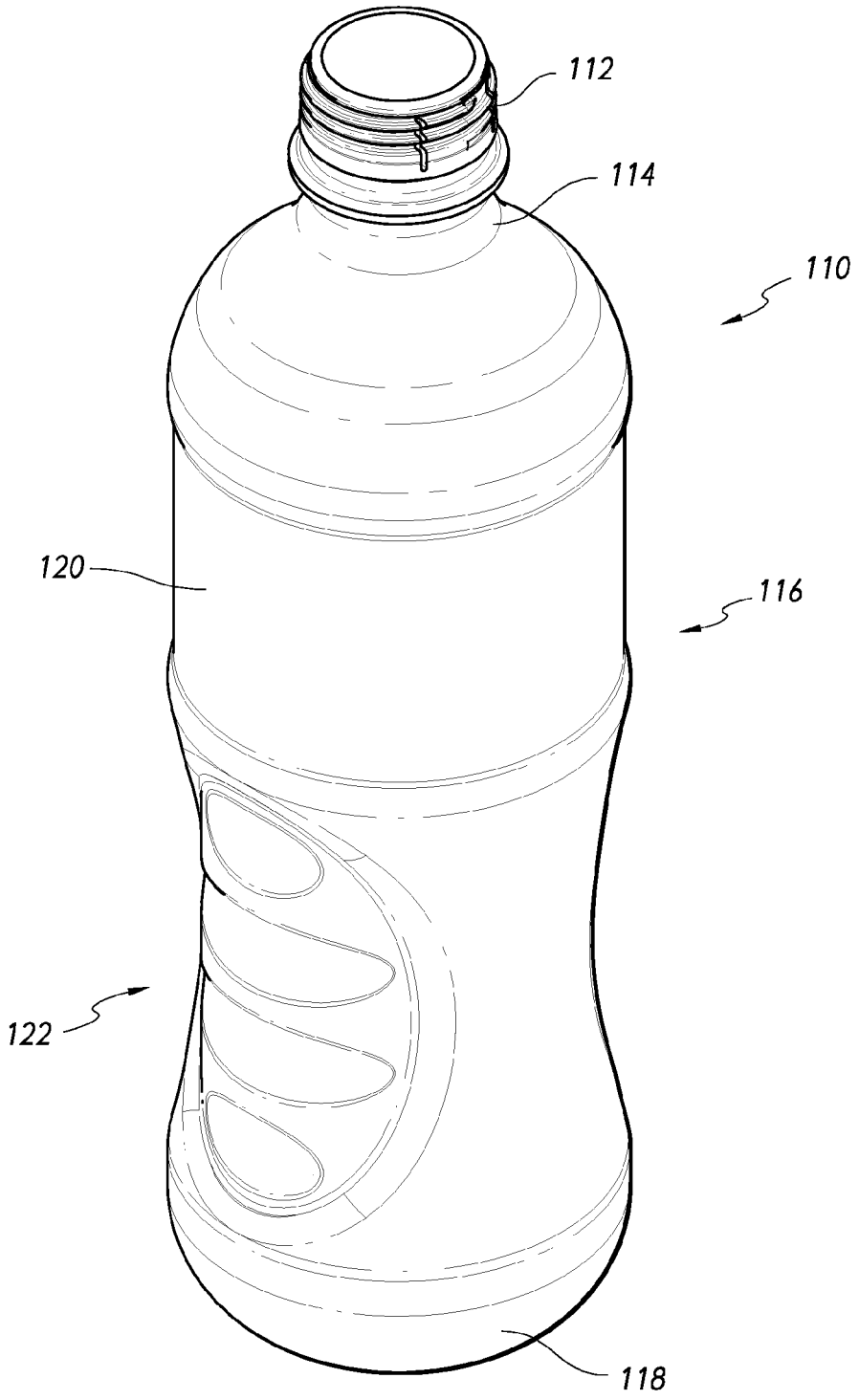
FIG. 7 is a perspective view depicting a container that is constructed according to an alternative embodiment of the invention.
Figure 9:
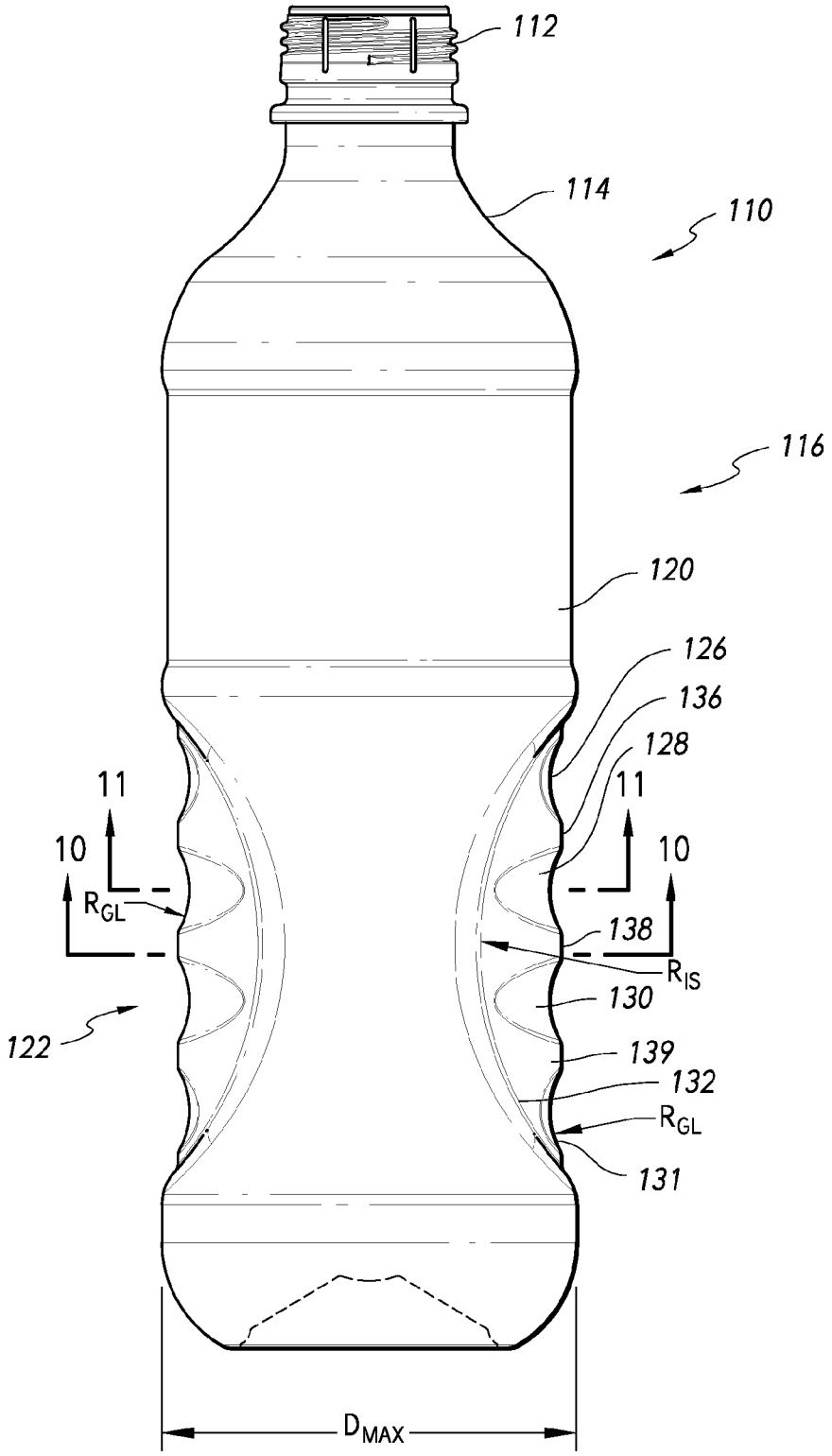
FIG. 9 is a front elevational view of the container that is shown in FIG. 7.

The outer surface 134 of each of the horizontal indentations 126, 128, 130, 131 is also preferably concave as viewed in longitudinal cross-section, as is best shown in FIGS. 7 and 9. Each of the horizontal indentations 126, 128, 130 preferably has a longitudinal radius of curvature $R_{GL}$ that is preferably within a range of about 0.2 inches to about 1 inch, and that is more preferably within a range of about 0.45 inch to about 0.85 inch. Preferably, the longitudinal radius of curvature $R_{GL}$ is within a range of about 10% to about 35% of the maximum outer diameter $D_{MAX}$ of the container 110, and more preferably within a range of about 15% to about 25% of the maximum outer diameter $D_{MAX}$ of the container 110.

Figure 11:
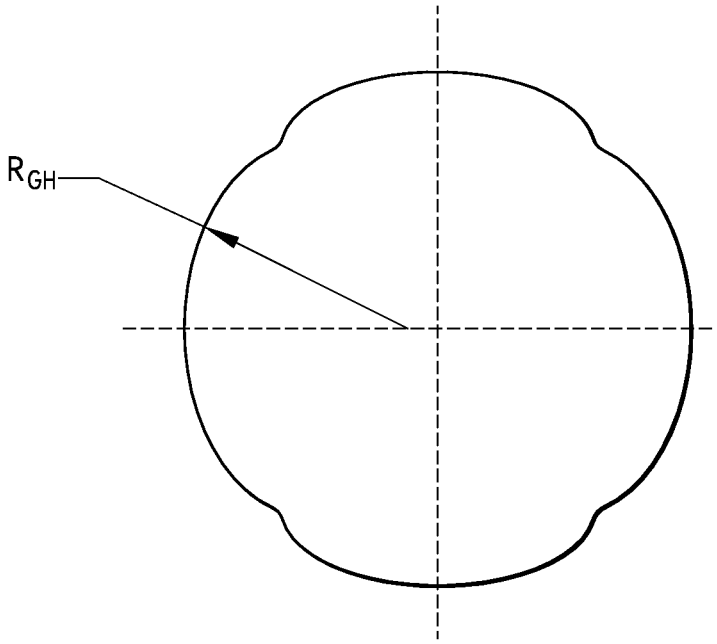
FIG. 11 is a cross-sectional view taken along lines 11-11 in FIG. 9.

FIG. 11 is a horizontal cross-sectional view depicting a cross-section of the container 110 taken at an elevation that intersects the second lip or projection 138. Both of the lips or projections 136, 138 have an outer surface that is convexly curved at a radius of curvature $R_{LH}$ that is preferably within a range of about 20 percent to about 50 percent of the maximum outer diameter $D_{MAX}$ of the container. Preferably, the radius of curvature $R_{LH}$ is within a range of about 0.6 inch to about 1.9 inch, and more preferably substantially within a range of about 1.0 inch to about 1.6 inch.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a shoulder portion having a convex annular rib defined therein; and a main body portion having a longitudinal axis, said main body portion having a gripping recess defined therein, said gripping recess being defined in part by a curved concave inner surface when viewed in side elevation, said gripping recess further comprising a plurality of horizontal indentations, each of said horizontal indentations being sized to receive a finger of a consumer when the plastic container is being gripped by the consumer; and wherein the annular rib has an average radius of curvature and the container has a generally cylindrical shape with a maximum outer diameter, and wherein a ratio of the average radius of curvature to the maximum outer diameter of the container is substantially within a range of about 0.10 to about 0.30.

2. A plastic container according to claim 1, wherein said plastic container further comprises a substantially smooth label portion.

3. A plastic container according to claim 1, and wherein said curved concave inner surface has a radius that is within a range of about 30 percent to about 130 percent of said maximum outer diameter.

4. A plastic container according to claim 3, wherein said radius of said curved concave inner surface is within a range of about 50 percent to about 100 percent of said maximum outer diameter.

5. A plastic container according to claim 1, wherein each of said horizontal indentations is concave as viewed in longitudinal cross-section.

6. A plastic container according to claim 1, wherein each of said horizontal indentations is curved as viewed in horizontal cross-section.

7. A plastic container according to claim 6, wherein each of said horizontal indentations is convexly curved as viewed in horizontal cross-section.

8. A plastic container according to claim 1, wherein each of said horizontal indentations is convexly curved as viewed in horizontal cross-section so as to have an external radius, said external radius being within a range of about 20 percent to about 70 percent of said maximum outer diameter.

9. A plastic container according to claim 1, wherein said gripping recess comprises at least three of said horizontal indentations.

10. A plastic container according to claim 1, wherein said container is made according to a blowmolding process.

11. A plastic container according to claim 1, wherein said gripping recess has an oblong shape when viewed in front elevation.

12. A plastic container according to claim 1, wherein the ratio of the average radius of curvature to the maximum outer diameter of the container is substantially within a range of about 0.15 to about 0.25.

13. A plastic container, comprising:

a shoulder portion having an annular rib defined therein;

a main body portion having a longitudinal axis, said main body portion having a gripping recess defined therein, said gripping recess having an oblong shape when viewed in front elevation, said gripping recess further comprising a plurality of horizontal indentations, each of said horizontal indentations being sized to receive a finger of a consumer when the plastic container is being gripped by the consumer; wherein the annular rib has an average radius of curvature and the container has a generally cylindrical shape with a maximum outer diameter, and wherein a ratio of the average radius of curvature to the maximum outer diameter of the container is substantially within a range of about 0.10 to about 0.30.

14. A plastic container according to claim 13, wherein said plastic container further comprises a substantially smooth label portion.

15. A plastic container according to claim 13, wherein said container is made according to a blowmolding process.

16. A plastic container according to claim 13, wherein each of said horizontal indentations is concave as viewed in longitudinal cross-section.

17. A plastic container according to claim 13, wherein each of said horizontal indentations is curved as viewed in horizontal cross-section.

18. A plastic container according to claim 13, wherein each of said horizontal indentations is convexly curved as viewed in horizontal cross-section.

19. A plastic container according to claim 13, wherein each of said horizontal indentations is convexly curved as viewed in horizontal cross-section so as to have an external radius, said external radius being within a range of about 20 percent to about 70 percent of said maximum outer diameter.

20. A plastic container according to claim 13, wherein said gripping recess comprises at least three of said horizontal indentations.

21. A plastic container according to claim 13, wherein the annular rib is convex.

22. A plastic container according to claim 1, wherein the ratio of the average radius of curvature to the maximum outer diameter of the container is substantially within a range of about 0.15 to about 0.25.

23. A plastic container according to claim 13, wherein the gripping recess has a curved concave inner surface having a radius within a range of about 30 percent to about 130 percent of the maximum outer diameter.

24. A plastic container according to claim 1, wherein each of said horizontal indentations has an outer surface with a longitudinal radius of curvature substantially within a range of about 0.2 inches to about 1 inch and a ratio of the longitudinal radius to the maximum outer diameter is substantially within the range of about 15 percent to about 35 percent.

25. A plastic container according to claim 13, wherein each of said horizontal indentations has an outer surface with a longitudinal radius of curvature substantially within a range of about 0.2 inches to about 1 inch and a ratio of the longitudinal radius to the maximum outer diameter is substantially within the range of about 15 percent to about 35 percent.

* * * * *